US005249875A

United States Patent [19]

Hori et al.

[11] Patent Number: 5,249,875

[45] Date of Patent: Oct. 5, 1993

[54] MARKER WITH PUMP AND FOLLOWER

[75] Inventors: Jiro Hori, 61-2, Ooazakamihiroya, Tsurugashima-machi, Iruma-gun, Saitama-ken; Katsumi Hori, Saitama, both of Japan

[73] Assignee: Jiro Hori, Saitama, Japan

[21] Appl. No.: 757,316

[22] Filed: Sep. 10, 1991

[30] Foreign Application Priority Data

| | | | |
|---|---|---|---|
| Sep. 11, 1990 | [JP] | Japan | 2-241013 |
| May 8, 1991 | [JP] | Japan | 3-102852 |
| May 8, 1991 | [JP] | Japan | 3-102853 |

[51] Int. Cl.[5] ..... B43K 5/06; B43K 8/04; B43K 5/18; B43K 7/10

[52] U.S. Cl. ..... 401/148; 401/141; 401/206

[58] Field of Search ..... 401/141, 148, 199, 206

[56] References Cited

U.S. PATENT DOCUMENTS

| | | | |
|---|---|---|---|
| 802,627 | 10/1905 | Chrysler et al. | 401/148 |
| 2,249,163 | 7/1941 | Nissen, Jr. | 401/141 |
| 2,606,529 | 8/1952 | Wagner | 401/141 |
| 2,783,488 | 3/1957 | Jockers | 15/139 |
| 3,153,804 | 10/1964 | Silver | 401/206 |
| 3,153,804 | 10/1964 | Silver | 15/569 |
| 3,233,275 | 2/1966 | Hansen et al. | 401/206 |
| 3,355,239 | 11/1967 | Albrecht | 401/148 |
| 3,397,939 | 8/1968 | Berry | 401/141 X |
| 3,656,857 | 4/1972 | Seregely | 401/142 |
| 3,792,932 | 2/1974 | Henriksen | 401/148 |
| 4,157,874 | 6/1979 | Durand | 401/4 |
| 4,364,684 | 12/1982 | Kohno et al. | 401/273 X |

FOREIGN PATENT DOCUMENTS

| | | | |
|---|---|---|---|
| 2592599 | 1/1987 | France . | |
| 2604640 | 10/1987 | France . | |
| 2052397 | 1/1981 | United Kingdom . | |
| 2170697 | 8/1986 | United Kingdom | 401/206 |

*Primary Examiner*—Steven A. Bratlie

*Attorney, Agent, or Firm*—Jacobson, Price, Holman & Stern

[57] ABSTRACT

A marker including a cylindrical ink reservoir formed in a body, a slide plug inserted into the ink reservoir, a pen element slidably installed at the end of the body in the axial direction, and an elastic sealing member for pressuring ink and sending it to the pen element. For writing, ink is supplied to the pen element by the elastic sealing member and adequate ink is constantly contained in the pen element.

4 Claims, 9 Drawing Sheets

MARKER WITH PUMP AND FOLLOWER

BACKGROUND OF THE INVENTION

1. Field of the Invention

The present invention relates to a white-board marker for writing on a white board, a writing-utensil-type paint marker for applying paint to the surface of metal or plastic material, a nail marker for applying manicure solution to nails, and a marker for applying liquid to a specified surface.

The present invention more particularly relates to an improvement of a marker storing a slidable slide plug in an ink reservoir.

2. Description of the Related Art

The above markers, unlike a writing utensil for writing characters on paper, are a kind of writing utensil configured to apply liquid in a relatively wide path. The structure of conventional markers is the same as that of a writing utensil for writing characters except that a pen element is thick. These markers use a pen element made of hardened fibers such as felt which is a so called felt tip.

These markers, however, should reserve a lot of ink because they consume ink in large quantities (hereafter referred to as ink and representing paint, manicure solution, and other liquid) unlike a writing utensil for writing characters.

For the writing utensil for writing characters (e.g. a felt-tip pen), the ink reservoir is filled with fibers such as cotton. Ink is held in reserve by making the fibers hold ink by means of capillarity, and writing is executed by absorbing the ink by the capillarity force of the felt tip.

Though this type of pen has a simple structure, it can reserve only a little ink. Therefore, this structure cannot be used for the above markers. A structure storing a slide plug in the ink reservoir is suitable to reserve a lot of ink. For this structure, a slidable slide plug maintaining liquid-tightness is inserted into a cylindrical ink reservoir. The ink reservoir is filled with liquid ink and the above slide plug separates the liquid ink from an air portion. As the ink is consumed or it is expanded or contracted due to temperature change, the slide plug slides to keep the pressure of the ink in the ink reservoir equal to the atmospheric pressure.

However, when the ink reservoir equipped with the above slide plug is used for markers, trouble occurs in that ink is inadequately absorbed from the pen element.

The first reason for this lies in the fact that the marker ink used for quick-drying ink, paint, and manicure solution has inadequate capillarity force because it has a comparatively high viscosity and contains an organic solvent. Therefore, the felt tip serving as a pen element has an inadequate ink-absorbing force. For aqueous ink used for a felt tip pen for writing characters, for example, the felt tip produces the absorbing differential pressure of 300 mmAq or more as the water head pressure. However, alcohol-based quick-drying ink used for white board markers produces the absorbing differential pressure of only approx. 100 mmAq under the same condition. When the above slide plug slides, it has a certain degree of sliding resistance. In addition, for an extremely small sliding resistance of the slide plug, ink drips from the pen element due to the water head pressure of the ink in the ink reservoir when the white board marker with the pen element turned downward is left as it is. Therefore, it is necessary to increase the sliding resistance of the slide plug to a certain degree. The slide plug is moved by the differential pressure produced when the above pen element or the felt tip absorbs ink. However, because the marker ink has inadequate capillarity force, ink may not completely be absorbed due to the sliding resistance of the slide plug.

The second reason lies in the fact that surfaces to which ink is applied by these markers have no water absorbing property because they are made of plastics or metal. Therefore, to completely apply ink to these surfaces, it is necessary for the marker felt tip to adequately contain ink. However, for markers which absorb ink by the capillarity force of the felt tip, like the conventional writing utensils, the felt tip cannot adequately contain ink.

Because of the above reasons, the amount of ink to be applied is limited for conventional markers. Therefore, no deep handwriting can be obtained by, for example, a white-board marker.

The present invention solves the above problems and it is an object of this invention to provide a marker having an ink reservoir storing a slide plug and capable of adequately supplying ink to a pen element.

SUMMARY OF THE INVENTION

The present invention has the following features to achieve the above object.

The pen element or felt tip of the marker of the present invention is supported so that it can slide along the pen axis. And, a pump means is installed which operates together with the felt tip. When writing pressure is applied to the pen element, the pen element slides along the pen axis and the above pump means operates to pressure the ink in the pen. And, ink is pushed to the pen element.

Because of these features, the marker of the present invention can adequately supply even the ink with a small capillarity force to the pen element regardless of the slide-plug resistance. Because the pen element or felt tip adequately contains ink, ink is adequately applied to the surfaces of plastics or metal having no water absorbing property. Therefore, wide-enough handwriting can be obtained by, for example, a white-board marker.

The marker of the present invention has a check valve system at the upstream and downstream sides of the pump means respectively. Therefore, ink is securely sent from the ink reservoir by these check-valve systems.

The marker of another embodiment has a check-valve system at the downstream side of the pump means, that is, between the pump means and the pen element and a resistance means for giving resistance to the circulating ink at the upstream side of the pump means, that is, between the pump means and the ink reservoir. The resistance means uses an orifice with a small diameter or a fiber resistance body made by hardening fibers. For this type of marker, when excessive writing pressure is applied and ink is excessively pressured by the pump means, some of the pressured ink is returned to the ink reservoir through the resistance means. Therefore, ink is not excessively supplied to the pen element.

The marker of still another embodiment is designed so that the above pump means pressures the ink in the ink reservoir. And, the sliding resistance of the above slide plug installed in the ink reservoir is set to the specified value. For this type of marker, the above slide plug is removed from the pen element when the ink reservoir is pressured by the pump means. In this case, the pressure in the ink reservoir reaches the value corresponding to the sliding resistance of the slide plug. For this type of marker, the structure is simple, the pressure in the ink reservoir is kept at a constant value corresponding to the sliding resistance of the slide plug even if excessive writing pressure is applied, and ink is supplied to the pen element by the constant pressure. Therefore, ink is stably supplied. For the marker of this embodiment, the above slide plug reciprocally slides back and forth whenever writing is executed.

In this case, it is preferable to set the axis-directional width of the contact surface between the sealing portion of the slide plug and the inner periphery of the ink reservoir so that it will be much smaller than the stroke of the reciprocating motion of the slide plug. By setting the width to the above condition, the sealing portion slides while contacting the inner periphery of the ink reservoir wetted by ink. Therefore, because ink serves as a lubricant between the sealing portion and the ink reservoir, the slide plug can return forward with a very small sliding resistance.

DETAILED DESCRIPTION OF THE PREFERRED EMBODIMENT

Embodiments of the present invention are described below according to the drawings. Though these embodiments are white-board markers, the present invention is not restricted to a white-board marker but it is applied to paint markers and nail markers. The embodiments described below correspond to various specifications required for markers respectively.

Figure 1:
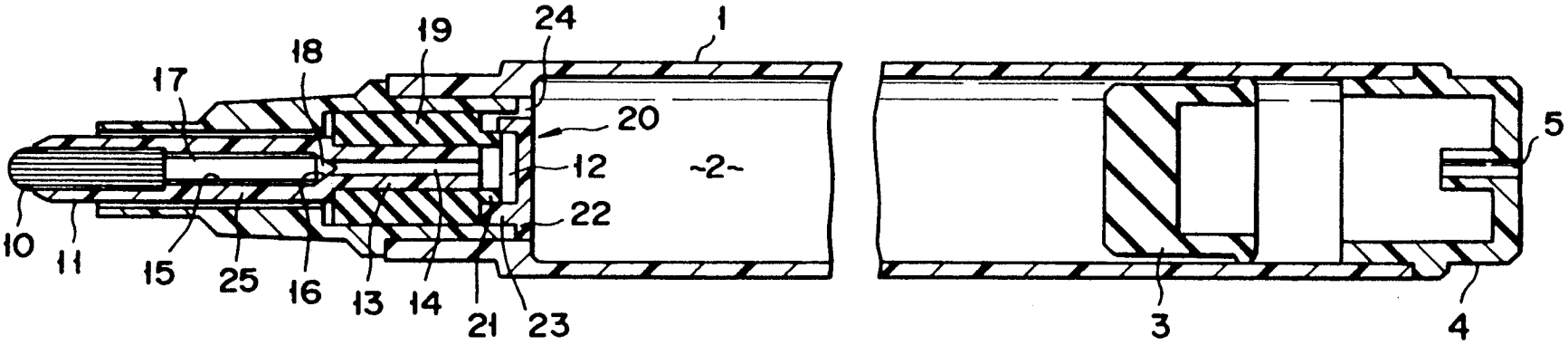
FIG. 1 is a longitudinal sectional view of the white-board marker of the first embodiment.

FIG. 1 shows the white-board marker of the first embodiment of the present invention.

In FIG. 1, numeral 1 is the body of the marker 20 which is cylindrical and whose inside is formed as a cylindrical ink reservoir 2. The ink reservoir 2 is filled with ink (e.g. quick drying ink using, for example, alcohol as a solvent). A slide plug 3 is installed in the ink reservoir 2. The slide plug 3 is made of elastic material such as silicone rubber or the like, which is slidably and liquid-tightly inserted into the body and separates liquid from air. Sliding of the slide plug 3 compensates for consumption of ink and expansion/contraction of it due to temperature change.

A tail plug 4 is installed at the rear end of the body 1 and an air through-hole 5 is formed on the tail plug 4.

A pen element 10 is installed at the front end of the body 1. For this embodiment, the pen element 10 is a felt tip made of hardened fibers. Because the pen element 10 is tapered and the shape of the tip of the pen element 10 is, for example, approximately spherical, the width of a drawn line varies depending on the writing pressure.

The pen element 10 is held by a holder 11. The holder 11 is installed slidably in the axial direction of the body 1 so that it can smoothly move back and forth together with the pen element 10.

A pump chamber 12 is formed in the body 1. The pump chamber 12 is connected with the ink reservoir 2 and pen element 10.

Ink pressuring means or a plunger 13 protrudes to the rear end of the holder 11. The plunger 13 passes through an elastic sealing member 19 and is inserted into the above pump chamber 12. For writing, the plunger 13 is inserted into the above pump chamber 12 because the above pen element 10 and holder 11 are moved backward by the writing pressure to decrease the volume of the pump chamber 12. Thus, the ink in the pump chamber 12 is pressured and the pressured ink is pushed out to the pen element 10 by passing through the ink paths 14 and 15 formed in the above holder 11 and plunger 13. Then, the pushed-out ink is contained in the pen element 10, that is, between fibers of the felt tip by capillarity The above elastic sealing member 19 serves as a sealing material and energizing means. That is, the elastic sealing member 19 is cylindrical and made of elastic material such as synthetic rubber. The elastic sealing member 19 is press-fitted to the inner periphery of the body 1 and the above plunger 13 is press-fitted into the member 19 in order to prevent the ink in the pump chamber 12 from overflowing through the gap between the above holder 11 and body 1. When the above holder 11 moves backward, the elastic sealing member 19 is compressed in the axial direction.

When writing pressure decreases, the holder 11 is projected by the elasticity of the elastic sealing member 19. Therefore, the elastic sealing member 19 also serves as an energizing means for energizing the holder 11 and pen element 10 in the protruding direction.

The following reservoir-side check-valve system 20 is installed between the above ink reservoir 2 and pump chamber 12. That is, an annular valve seat 23 is protruded to the pump chamber side on the partitioning member 22 for partitioning the above pump chamber 12 from the ink reservoir 2. The annular valve element section 21 is protruded at the pump-chamber-side end of the above elastic sealing member 19 and fitted to the inner periphery of the above valve seat 23 by the elasticity of its own. A channel 24 is formed on a part of the outer periphery of the above partitioning member 22, which is connected with the above ink reservoir 2 and opens on the inner periphery of the above valve seat 23.

The above reservoir-side check-valve system 20 closes the opening of the channel 24 because the above valve element section 21 adheres to the inner periphery of the valve seat 23 when the pressure in the pump chamber 12 increases, preventing ink from returning to the ink reservoir 2. When the pressure in the pump chamber 12 decreases, the valve element section 21 separates from the inner periphery of the valve seat 23 and ink enters the pump chamber 12 from the ink reservoir 2 through the channel 24. The following pen-element-side check-valve system 25 is installed between the pump chamber 12 and pen element 10. That is, a conical valve seat 16 is formed between the above ink paths 14 and 15. And, a valve element 17 is inserted into the above path 15. The valve element 17 is cylindrical and made of elastic material such as synthetic rubber. The outside diameter of the valve element 17 is smaller than the inside diameter of the ink path 15 and a gap for circulating ink is formed between them. The pump-chamber-side end of the valve element 17 is conically formed on a valve-element section 18. The valve-element section 18 is seated on the above valve seat 16. The pen-element-side end of the valve element 17 contacts the pen element 10, the Valve element 17 is slightly compressed in the axial direction, and the above valve element section 18 is pressed against the above valve seat 16 by the elasticity of the compressed valve element.

For the pen-element-side check-valve system 25 with the above construction, the valve element section 18 separates from the valve seat 16 because the above valve element 17 is compressed in the axial direction and the ink in the pump chamber 12 is sent to the pen element 10 when the pressure in the pump chamber 12 is high, while the ink flowing to the pump chamber is interrupted because the valve element section 18 is adhered by the valve seat 16 when the pressure in the pump chamber 12 is low.

The function of the above marker is described below.

When pressing the marker pen element 10 against the surface of a white board for writing, the pen element 10 moves backward or withdraws together with the holder 11, the elastic sealing member 19 is compressed in the axial direction, and the plunger 13 enter the pump chamber 12. Therefore, the volume of the pump chamber 12 decreases and ink is pressured. In this case, the above reservoir-side check-valve system 20 closes and the pen element-side check-valve system 25 opens. Therefore, the ink in the pump chamber 12 is pushed out to the pen element 10.

The pushed-out ink is held by and contained in fibers of the felt tip by capillarity. When the pen element 10 separates from the white board surface after writing, the holder 11 and pen element 10 move forward or protrude by the elasticity of the elastic sealing member 19, the plunger 13 is drawn out of the pump chamber 12, the volume of the pump chamber 12 increases, and the pressure in the pump chamber 12 decreases. In this case, the pen-element-side check-valve system 25 closes, ink is prevented from returning from the pen element 10 to the pump chamber 12, the reservoir-side check-valve system 20 opens, and the ink in the ink reservoir 2 enters the pump chamber 12. At the same time, the slide plug 3 slides corresponding to consumption of the ink in the ink reservoir to compensate for lack of ink.

Hereafter, ink is supplied to the pen element 10 in the same manner each time writing is executed. Therefore, a certain amount of ink is constantly contained in the pen element.

For writing, the writing pressure increases as the width of the drawn line increases and the writing speed increases or ink consumption increases. Therefore, the entering distance of the plunger 13 increases and the amount of ink to be pushed out to the pen element 10 increases. Thus, stable writing is realized because the amount of ink contained in the pen element 10 is properly maintained so that wide-enough writing is realized and no ink drips.

Also, sliding of the above slide plug 3 compensates for consumption of the ink in the ink reservoir 2 and expansion/contraction of ink due to temperature change.

Moreover, the ink contained in the above pen element 10 is prevented from returning to the pump chamber 12 by the pen-element-side check-valve system 25. Therefore, when the pen element is turned upward and left as it is or even if differential pressure is produced between the inside and outside of the marker due to change of atmospheric pressure, the ink contained in the pen element 10 is prevented from returning to the pump chamber 12. Therefore, because the pen element 10 constantly contains adequate ink, the pen element does not become dry even if it is left as it is for a long time with its cap removed. If the pen element 10 should become dry after it is left as it is for a long time with its cap removed, writing is possible because ink is forcibly pushed out to the pen element 10 by strongly pressing the pen element 10 against the white-board surface several times.

Figure 2:
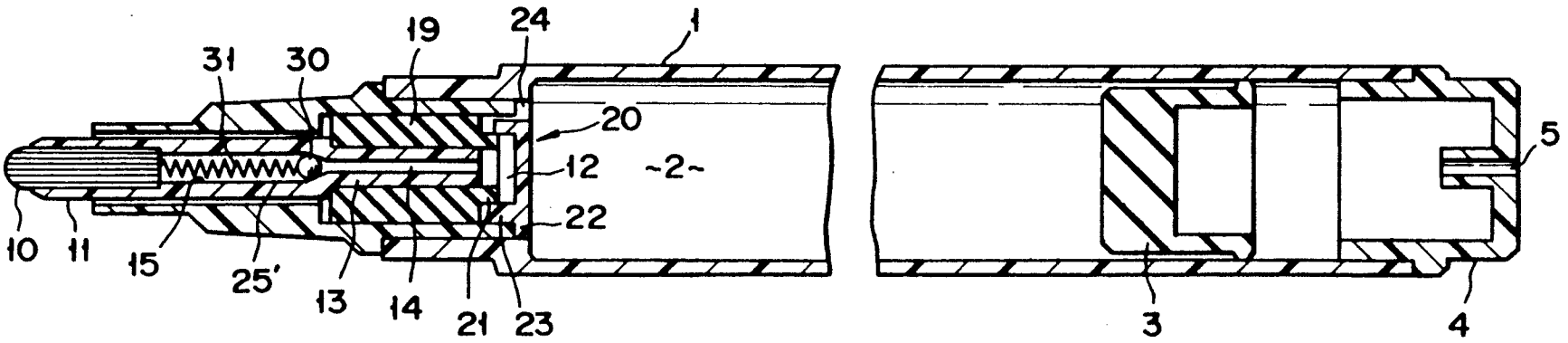
FIG. 2 is a longitudinal sectional view of the white-board marker of the second embodiment.

FIG. 2 shows the second embodiment of the present invention. This embodiment has the same construction as the first embodiment except the above pen-element-side check-valve system 25.

That is, the pen-element-side check-valve system 25' of this embodiment has a valve element 30 consisting of a steel ball inserted into the above ink path 15, and a compression coil spring 31. The valve element 30 is pressed against the above valve seat 16 by the compression coil spring 31.

Though this embodiment has a more complex construction than the first embodiment, it has a feature that the opening pressure of the pen-element-side check valve 25' can be more accurately set.

Figure 3:
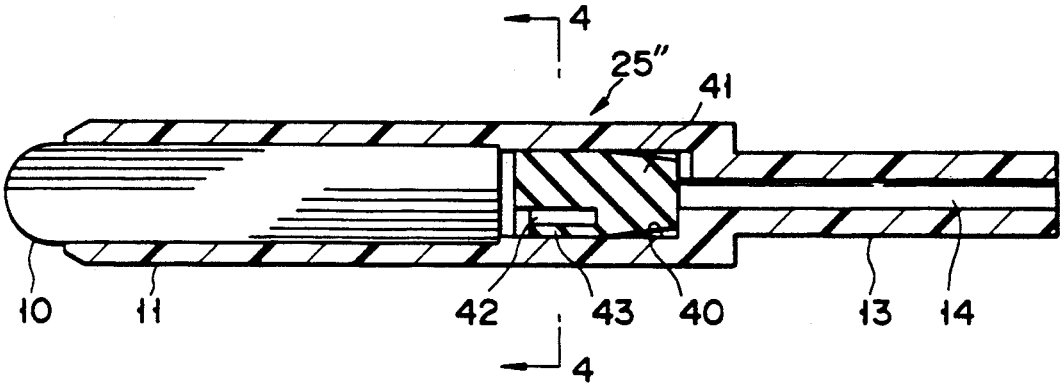
FIG. 3 is a longitudinal sectional view of the pen element and check valve of the white-board marker of the third embodiment.
Figure 4:
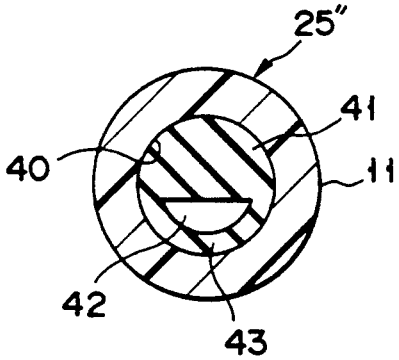
FIG. 4 is a transverse sectional view along the line 4—4 in FIG. 3.

FIGS. 3 and 4 show the third embodiment of the present invention. The third embodiment has the same construction as the first embodiment except the pen-element-side check-valve system 25". FIGS. 3 and 4 show only the pen element and holder. This embodiment has a valve seat chamber 40 in the above holder 11 and a valve element 41 consisting of elastic material such as silicone rubber in the valve seat chamber 40. The valve element 41 is approximately columnar and its outer periphery is tapered, which is press-fitted into the valve seat chamber 40. A recess 42 with approximately segmental cross section is formed on the end of the valve element 41 at the pen-element 10 side and a part of the outer periphery of the valve element 41 is formed on a thin-wall elastic valve 43 by the recess 42. The elastic valve 43 is formed so that it can be elastically deformed inwardly in a radial direction. The margin of the elastic valve 43 is recessed from the pen-element side end of the valve element 41 to prevent the margin of the elastic valve 43 from being caught by the valve element 41 when the valve element 41 is press-fitted into the valve seat chamber 40.

For the pen-element-side check-valve system 25'', when the above elastic valve 43 is elastically deformed inwardly in a radial direction, the elastic valve 43 separates from the inner periphery of the valve seat chamber 40, and ink flows from the pump chamber to the pen element and the pump chamber pressure increases. When the pump chamber pressure decreases, the above elastic valve 43 adheres to the inner periphery of the valve seat chamber to prevent ink from returning from the pen element side to the pump chamber side.

The third embodiment is easily assembled and its check valve securely operates.

Figure 5:
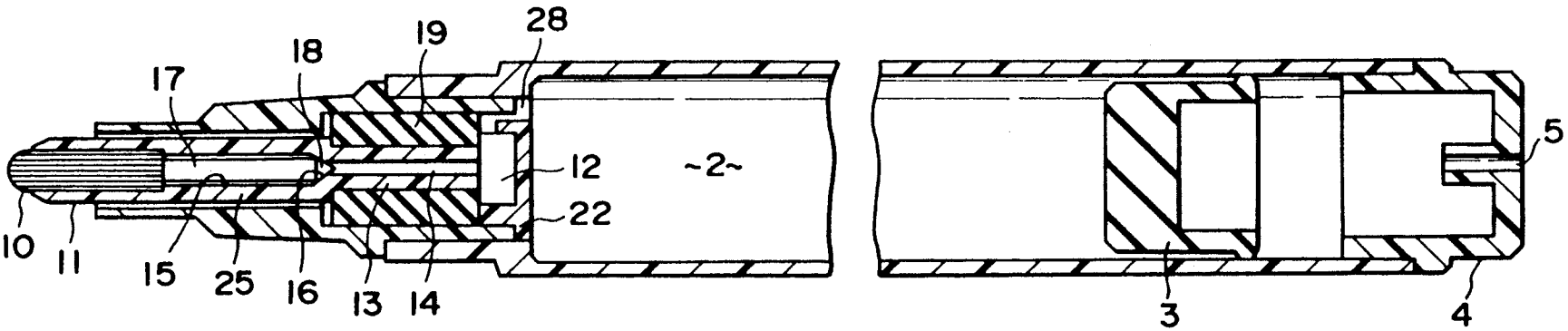
FIG. 5 is a longitudinal sectional view of the white-board marker of the fourth embodiment.

FIG. 5 shows the fourth embodiment. This embodiment does not have the above reservoir-side check-valve system. Instead, the ink reservoir 2 is connected with the pump chamber 12 by a resistance path 24. The resistance path 24 is a narrow channel formed on a part of the outer periphery of the partitioning member 22 for partitioning the pump chamber 12 from the ink reservoir 2, which is designed to give a certain resistance to the ink flowing through the path.

This embodiment has the same construction as the first embodiment except for the above point and its parts corresponding to those of the first embodiment, are in FIG. 5, provided with the same symbols.

For this embodiment, some of the ink returns to the ink reservoir 2 through the resistance path 24 when the ink in the pump chamber 12 is pushed out for writing by the pump function. Meanwhile, because the above pen element 10 is felt tip made by hardened fibers, it contains ink by capillarity.

In this case, when the amount of contained ink is small, ink is absorbed from the pump chamber 12 by capillarity. As the amount of contained ink increases, the absorbing force decreases and the felt tip is saturated with ink. When the amount of contained ink becomes excessive, the pressure on the ink contained in the pen element increases. Therefore, the amount of ink returning to the ink reservoir 2 through the above resistance path 24 increases and the amount of ink to be pushed out to the pen element 10 decreases as the amount of ink contained in the pen element 10 increases. Thus, the amount of ink contained in the pen element 10 can securely be controlled. In addition, it is possible to control the amount of ink to be pushed out to the pen element so that the amount of ink is kept constant when the amount of ink contained in the pen element 10 reaches a certain limit by properly setting the resistance of the above resistance path 24 and the valve opening pressure of the check-valve system 25. Thus, when pressing the pen element against the white board several times without writing, ink is prevented from dripping due to excessive supply of ink to the pen element 10.

Figure 6:
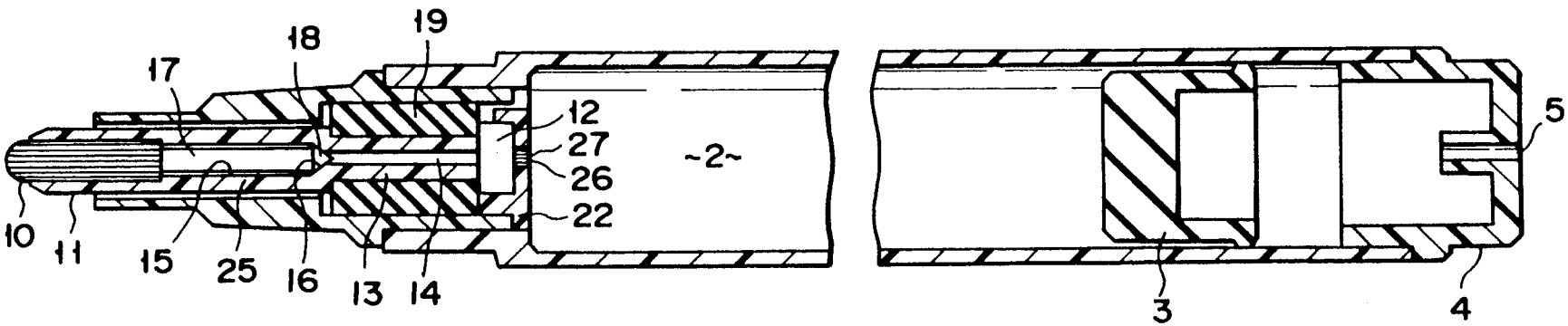
FIG. 6 is a longitudinal sectional view of the white-board marker of the fifth embodiment.

FIG. 6 shows the fifth embodiment of the present invention. This embodiment has the same construction as the first embodiment except the resistance path 24.

That is, for this embodiment, a path 26 is formed on the bottom wall of the above partitioning member 22, the pump chamber 12 is connected with the ink reservoir 2 by the path 26, and a felt resistance body 27 made by hardening fibers is installed in the path 26. A certain resistance is given to the ink flowing through the path 26 by the resistance body 27.

For this embodiment, because the resistance body 27 giving resistance to ink is made of porous material made by hardening fibers the same as for the pen element the resistance characteristic, when ink flows through the resistance body 27, is approximately the same as that of the pen element 10. Therefore, when ink is pushed out of the pump chamber 12, it is possible to stably control the rate between the amount of ink to be pushed out to the pen element 10 and the amount of ink returning to the ink reservoir 2 through the resistance body 27.

Figure 7:
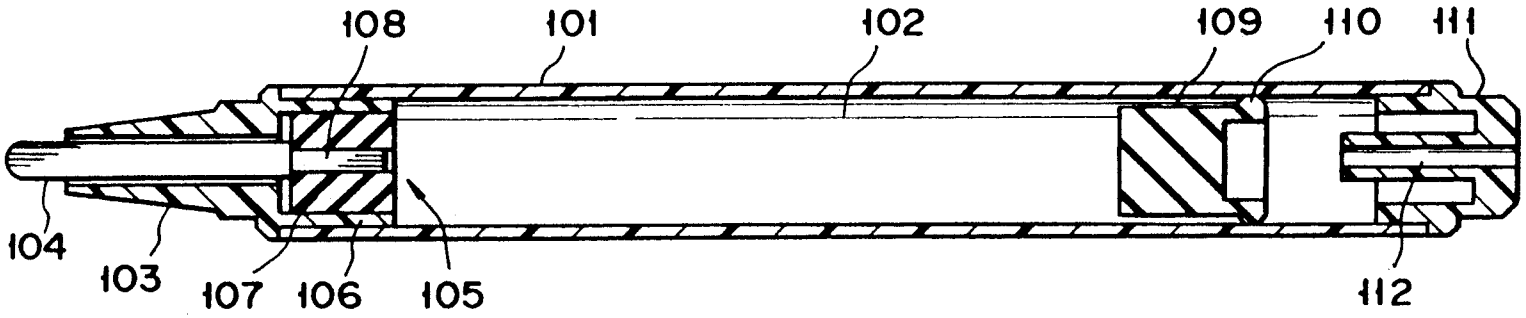
FIG. 7 is a longitudinal sectional view of the white-board marker of the sixth embodiment.
Figure 8:
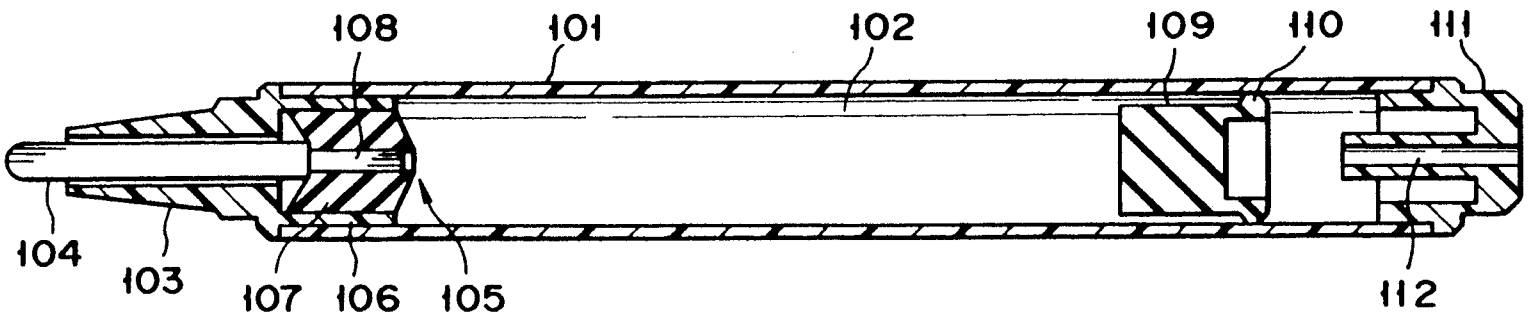
FIG. 8 is a longitudinal sectional view of the white-board marker of the sixth embodiment under another operating state.
Figure 9:
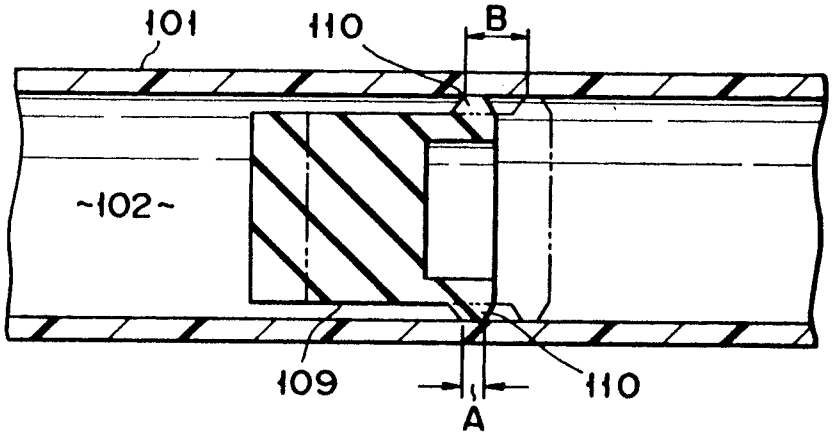
FIG. 9 is a longitudinal sectional view of the slide plug of the white-board marker shown in FIGS. 7 and 8.

FIGS. 7 through 9 show the sixth embodiment of the present invention. In the FIGURES, numeral 101 is the body of this white-board marker, which is cylindrical and whose inside is formed as an ink reservoir 102.

A pen-element holder 103 is installed at the front 5 end of the body 101. On the pen-element holder 103, a pen element (a felt tip 104 for this embodiment) is installed slidably in the axial direction so that it can be moved in the axial direction by writing pressure.

In addition, a pump system 105 is installed between the pen element 104 and the ink reservoir 102, which has the following construction. That is, a cylindrical holding section 106 is formed at the rear end of the above pen element holder 103 and a piston 107 made of elastic material such as silicone rubber is fitted into the holding section 106. A hole is formed passing through the center of the piston 107. A fitting section 108 with decreased diameter is formed at the rear end of the above felt tip 104 and the fitting section 108 is fitted into the hole of the piston 107.

Therefore, when writing pressure is applied to the felt tip 104 for writing with the white-board marker, the felt tip 104 withdraws and the piston 107 is deformed as shown in FIG. 2 so that the volume of the above ink reservoir 102 is decreased and the ink in the ink reservoir 102 is pressured. When no writing pressure is applied, the above piston 107 returns to the state shown in FIG. 7 by its own elasticity. In this case, the volume of the ink reservoir 102 increases.

A slide plug 109 is slidably installed in the above ink reservoir 102. The slide plug 109 is made of elastic material such as fluorine-based silicone rubber or other type of silicone rubber and an annular sealing portion 110 protrudes from the outer periphery of the plug. The elastically-deformed top of the sealing portion 110 adheres to the inner periphery of the above ink reservoir 102 to maintain sealing quality. The axis-directional width on the surface adhered with the inner periphery of the ink reservoir 102 of the sealing portion 110 under the above condition, that is, the sealing width is assumed as A as shown in FIG. 9.

In addition, a tail plug 111 is installed at the rear end of the body 101 and a hole 112 connected with atmospheric air is formed on the tail plug 11.

The above ink reservoir 101 is filled with liquid ink for example, quick drying ink and the ink is partitioned from air by the above slide plug 109. The slide plug 109 slides corresponding to consumption of the ink so that the pressure in the ink reservoir 102 is kept equal to the atmospheric pressure. When the pressure for writing is applied to the above felt tip 104, the felt tip 104 withdraws, the piston 107 is deformed as shown in FIG. 8, and the ink in the ink reservoir 102 is pressured; some of the ink passes through the hole of the piston 107 and is supplied through the felt tip 104 and its fitting portion 108. Meanwhile, when the ink reservoir 102 is pressured, the above slide plug 109 moves backward as shown by a two-dot chain line in FIG. 9. In this case, the movement of the plug 109 is assumed as B. The movement B changes according to the writing pressure applied to the above felt tip 104, that is, the deformation of the piston 107.

The dimension and elasticity of the piston 107 are set so that the movement B of the above slide plug 109 will be larger than the sealing width A of the sealing portion 110 of the slide plug 109 when the standard writing pressure (the pressure of 100 g for this embodiment) is applied to the above felt tip 104.

For the above writing utensil, the pressure for writing greatly varies depending on the service condition or the writer. For example, to perform writing on an approximately-vertical white board by holding the tail of the white board marker with fingers, the writing pressure may range only between 5 and 10 g. When writing is performed by a writer tending to perform writing with a strong pressure or tending to strongly press the white board marker against the writing surface at the end of writing, the instantaneous maximum writing pressure may reach several hundreds of grams. However, for the writing test of marking pens specified in JIS-S-6037, the standard writing pressure for the test is specified as 100 g for oil based ink and as 50 g for water based ink. As the result of the test by the inventor et al., the above standard writing pressure is instantaneously applied in normal writing of one character or stroke. For the present invention, instantaneous writing pressure is enough to withdraw the slide plug by a certain distance. Therefore, for this embodiment, the function of the present invention is completely achieved by setting the withdrawal distance B of the slide plug 109 so that it will exceed the sealing width A when the above standard writing pressure of 100 g is applied.

The initial sliding resistance for the slide plug 109 to start moving is set to a value larger than the load when the water head pressure of the ink filled in the above ink reservoir 102 is applied to the slide plug 109.

The following is the description of the function of the above embodiment.

First, when no writing is being done and the slide plug 109 is stopped, the surface of the sealing portion 110 adheres to the inner periphery of the ink reservoir 102. Because little ink film is present between the surface and the inner periphery, the sealing portion directly contacts the inner periphery of the ink reservoir 102. Under the above condition, the friction coefficient between them is relatively large and the sliding resistance of the slide plug 109 is large.

Then, when writing is executed with the white board marker, the writing pressure is applied to the above felt tip 104, the felt tip 104 withdraws, the piston 107 of the pump system 105 is deformed, and the ink in the ink reservoir 102 is pressured. In this case, though the slide plug 109 withdraws, the inner periphery of the ink reservoir 102 at the tail-plug 111 side of the sealing portion 110 of the slide plug 109 is dry because no ink is attached to it. Therefore, when the slide plug 109 withdraws the sealing portion 110 and the inner periphery of the ink reservoir 102 slide while contacting each other without an ink film between them. Therefore, in this case, the sliding resistance of the slide plug 109 becomes relatively large and the pressure in the ink reservoir 102 gets relatively high corresponding to the sliding resistance for withdrawal of the slide plug 109. The material of the felt tip 104 and the diameter of the fitting portion 108 are set so that the amount of ink to be consumed for one stroke of writing is sent to the felt tip 104 under the above pressure. Therefore, the felt tip 104 always contains the amount of ink most suitable for writing.

In this case, when the standard writing pressure is applied, the movement B for withdrawal of the slide plug 109 exceeds the sealing width A of the sealing portion 110. Therefore, the inner periphery of the ink reservoir 102 to which the sealing portion 110 adheres, until withdrawal of the slide plug, is wet by ink. Even if excessive writing pressure is applied depending on the writer, the ink pressure in the ink reservoir 102 hardly changes though the withdrawal distance of the slide plug 109 increases. Therefore, ink is stably supplied.

When writing pressure is released at the end of writing for one stroke; the piston instantaneously recovers by its own elasticity, the pressure in the ink reservoir 102 instantaneously becomes negative, and the slide plug 109 instantaneously advances to the position before withdrawal. In this case, because the inner periphery of the ink reservoir 102 to which the sealing portion 110 adheres until withdrawal is already wet by ink, ink film is formed between the sealing portion 110 and the inner periphery of the ink reservoir 102 and the sliding resistance of the slide plug 109 is greatly decreased by lubrication of the ink film. And, the slide plug 109 further advances from the position before withdrawal by a very small distance corresponding to the amount of ink consumed due to one-stroke writing. In this case, because the sealing portion 110 of the slide plug 109 is lubricated by the ink film, it smoothly moves by a very small distance. Therefore, negative pressure is not left in the ink reservoir unlike the conventional type. Thus, ink is stably supplied because the ink contained in the felt tip 104 is not returned to the inside by the negative pressure.

Because the above operation is repeated, the amount of ink consumed for every single stroke of writing is supplied to the felt tip 104 and a proper amount of ink for writing on the surface of a white board or the like having no water absorbing property is always contained in the felt tip 104.

The material and density of the felt tip 104 are set so that wide writing can be made on the surface of a white board or the like having no water absorbing property and the capillarity force will be relatively small. Therefore, because the ink holding ability of the felt tip 104 or the sealing ability is low, ink may be excessively contained in the felt tip or may drip due to the water head pressure of the ink in the ink reservoir 102 when the felt tip is turned downward. For this embodiment, however, the sliding resistance when the slide plug 109 stops, that is, when ink film is not formed between the sealing portion and the inner periphery of the ink reservoir 102 is set large enough to support the water head pressure of the ink. Therefore, the above trouble is completely prevented.

Figure 10:
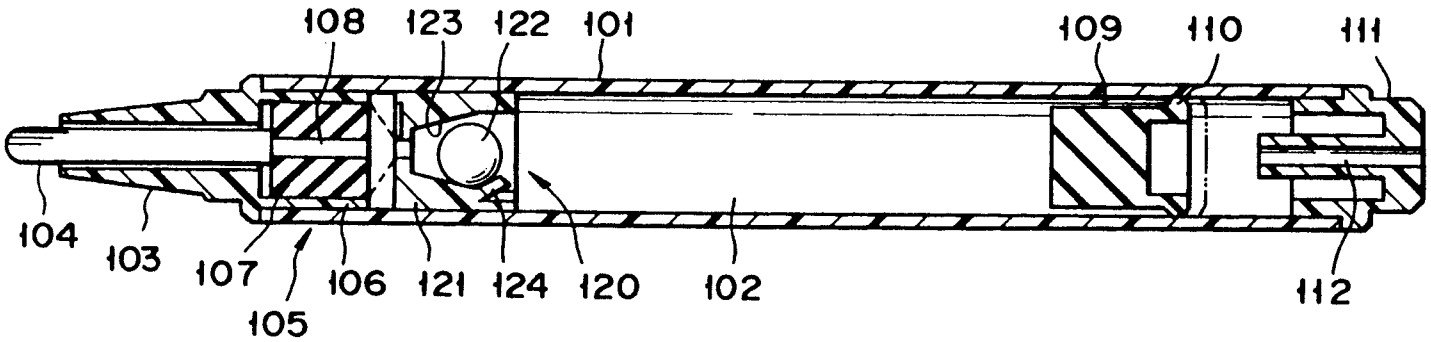
FIG. 10 is a longitudinal sectional view of the white-board marker of the seventh embodiment.
Figure 11:
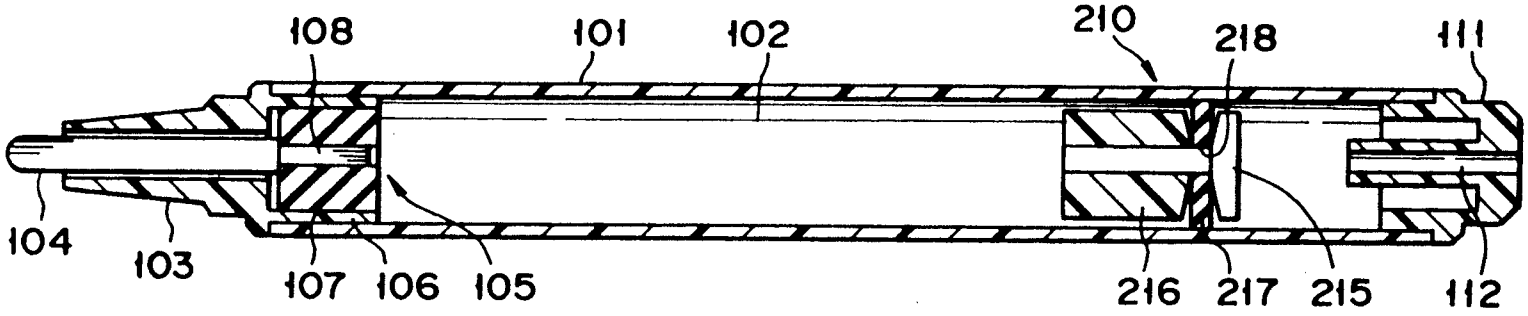
FIG. 11 is a longitudinal sectional view of the white-board marker of the eighth embodiment.

FIG. 10 shows the seventh embodiment of the present invention. This is a white board marker designed by considering a very small writing pressure. The seventh embodiment has the basically same construction as the sixth embodiment. In FIG. 10, the parts corresponding to those of the sixth embodiment are provided with the same symbols and their description is omitted.

Some writers execute writing at a very small writing pressure by holding the rear end of the white board marker. In this case, the writing pressure is only approx.

10 g. Therefore, to set the movement B for withdrawal of the slide plug 109 larger than the sealing width A of the sealing portion 110, it is necessary to decrease the elasticity of the piston 107 of the pump system 105 so that a necessary stroke can be obtained even for a small writing pressure and also decrease the sliding resistance for withdrawal of the slide plug 109, that is, the sliding resistance when no ink film is present between the sealing portion 110 and the inner periphery of the ink reservoir 102. Thus, when the felt tip 104 is turned downward, ink may drip from the felt tip 104 because the water head pressure of the ink in the ink reservoir 102 cannot be supported by the initial sliding resistance of the slide plug 109.

For the seventh embodiment shown in FIG. 10, a shut-off valve system 120 is installed between the pump system 105 and ink reservoir 102 in order to prevent the above ink from dripping.

The shut-off valve system 120 has a housing 121 which is fitted into the above body 101. A tapered through-hole 123 is formed on the housing 121 and the ink reservoir 102 is connected with the pump system 105 by the through-hole 123. A steel ball functioning as a valve element is inserted into the through-hole 123. A stopper 124 is protruded at the inside of the rear end of the housing 121 to prevent the steel ball 122 from dropping out.

The piston 107 of the pump system 105 contacts the casing 121 of the shut-off valve system 120 so that the maximum stroke is controlled and the casing 121 also serves as a stopper for controlling the maximum stroke of the pump system 105.

When this type of marker is approximately horizontal for writing, the steel ball 122 drops out of the through-hole 123 by gravity, the through-hole 123 is open, and ink is supplied from the ink reservoir 102 to the pump system. Other functions are the same as those of the sixth embodiment.

When writing is stopped and the felt tip 104 is turned downward, the steel ball 122 is fitted into the tapered through-hole 123 by gravity to close the through-hole 123. Therefore, supply of ink is interrupted and dripping of ink from the felt tip 102 is securely prevented.

For this embodiment, because the piston 102 of the pump system 105 is designed to have small elasticity, the piston 107 may excessively be deformed if a large writing pressure is applied. However, the above trouble will not occur because the piston 107 contacts the casing 121 and its maximum stroke is controlled.

FIGS. 11 through 14 show a white board marker of the eighth embodiment of the present invention. This embodiment has the same construction as the sixth embodiment shown in FIG. 7 except for the slide plug 210.

That is, the slide plug 210 comprises a body consisting of a sleeve member 216 and a pressing member 215, and a sealing portion 217. The sealing portion 217 is a thin disk made of, for example, an elastic material such as silicone rubber or fluorine-based silicone rubber. A mounting hole 218 is formed at the center of the sealing portion 217. The pressing member 215 passes through the mounting hole 217 to secure the sealing portion 217 to the sleeve member 216. The top ends of the sleeve member 216 and the pressing member 215 are conical so that the sealing portion 217 is not bent.

The outer periphery 219 of the sealing portion 127 is formed to be columnar around the central axis of the slide plug 210 or the ink reservoir 102. The diameter of the sealing portion 217 is slightly larger than the inside diameter of the ink reservoir 102, the sealing portion 217 is slightly compressed in the radial direction, and the outer periphery 219 adheres to the inner periphery of the ink reservoir 102 at a certain contact pressure according to the elasticity of the sealing portion.

The following is the description of the function of the slide plug 210 of this embodiment.

First, when no writing is executed, that is, no differential pressure is produced at both ends of the slide plug 210, the sealing portion 217 is a flat disk and the whole surface of the outer periphery 21 adheres to the inner periphery of the ink reservoir 102.

Then, when writing is executed, the ink reservoir 102 is pressured by the pump system 105, the slide plug 210 slides, and the pressure in the ink reservoir 102 is increased to a value corresponding to the sliding resistance of the slide plug 210.

Figure 12:
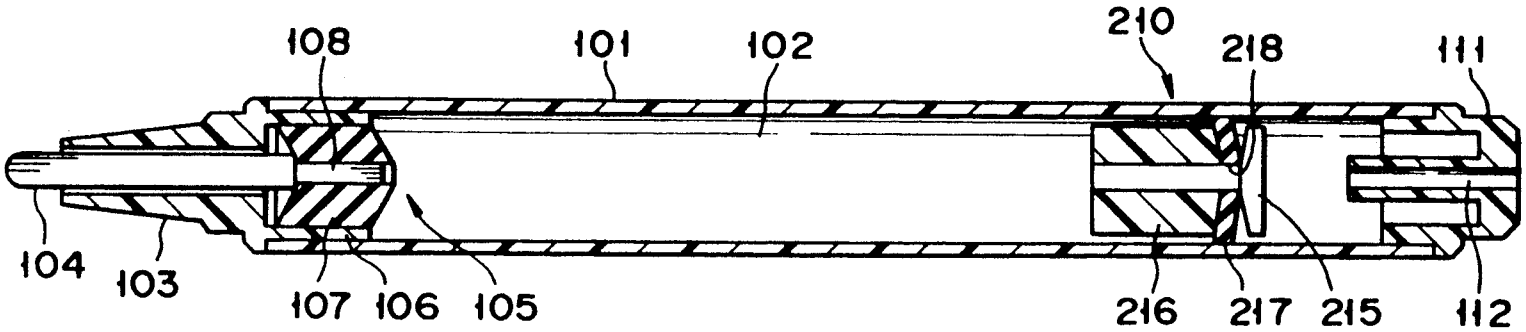
FIG. 12 is a longitudinal sectional view of the white-board marker shown in FIG. 11 under another operating state.
Figure 13:
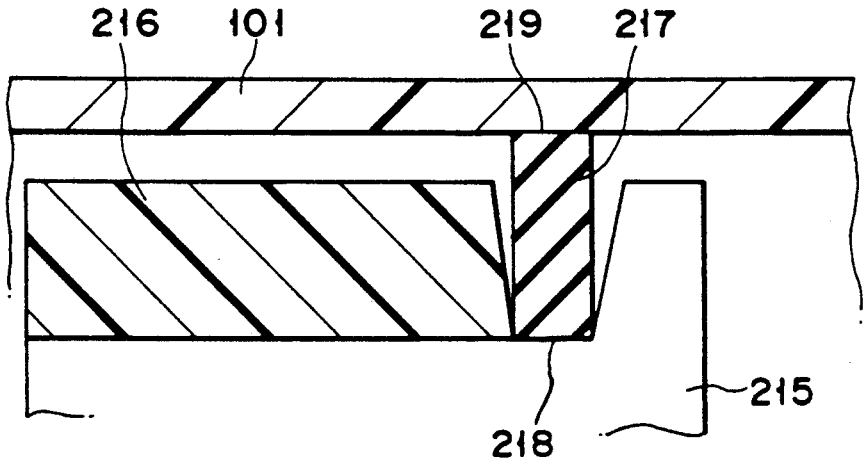
FIG. 13 is a longitudinal sectional view of the slide plug of the white-board marker shown in FIGS. 11 and 12.
Figure 14:
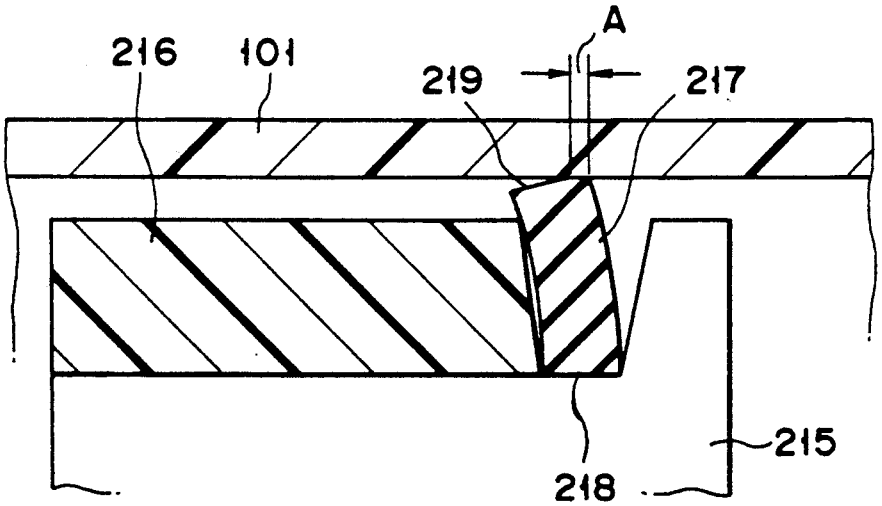
FIG. 14 is a longitudinal sectional view of the slide plug of the white-board marker shown in Figs. Il and 12 under another operating state.

When the ink reservoir 102 is pressured, the pressure is applied to the sealing portion 217 and the sealing portion 217 is bent as shown in FIGS. 12 and 14. When the sealing portion 217 is bent, the diameter of the sealing portion 217 decreases and its outer periphery 219 is tapered. Therefore, as shown in FIG. 14, one side margin of the outer periphery 219 or the margin at the ink side separated from the inner periphery of the ink reservoir 102. However, the other side margin of the outer periphery 219 or the margin at the air side continuously adheres to the inner periphery of the ink reservoir 102.

Then, as the pressure in the ink reservoir 102 increases; the sealing portion 217 is further bent, the contact pressure of the outer periphery 219 decreased, and the adhering width A of the other side margin decreases. Therefore, the sliding resistance of the slide plug 210 further decreases and, when the sliding resistance is smaller than the load applied to the slide plug 210 due to the pressure in the ink reservoir 102, the slide plug 210 starts sliding.

In this case, the sealing portion 217 becomes sensitive to the pressure in the ink reservoir 102, that is, the sealing portion 217 is greatly bent even for a small change of the pressure.

Therefore, even if an error is present in the contact pressure of the outer periphery of the sealing portion 217 under the initial state, the error is compensated for by a larger bending of the sealing portion 217. In this case, the error of the pressure in the ink reservoir 102 is small. Therefore, the sliding resistance of the slide plug 210 gets small and accurate.

When the pressure for writing of one character is released, the piston 107 of the pump system recovers by its own elasticity and the ink reservoir 102 becomes subject to negative pressure. In this case, the sealing portion 217 is bent in the direction opposite to the above case, one side margin of the sealing portion 217 adheres to the inner periphery of the ink reservoir 102, and the slide plug 210 advances similarly to the above operation. Thus, the sliding resistance is small and accurate similarly to the above case. In this case, because the adhered portions at the other side margin successively move to the one side margin, the ink film between the one side margin and the inner periphery of the ink reservoir 102 is removed.

And, when the slide plug 210 advances, one side margin adheres to the inner periphery of the ink reservoir 102 to wipe the ink on the inner periphery. Therefore, no ink film is left in the inner periphery of the ink reservoir 102. The width A at the adhering portion of the outer periphery is not decreased to zero, that is, the entire outer periphery does not separate from the inner surface of the ink reservoir 102. Therefore, the ink is completely wiped in any case.

This embodiment is suitable when the wall of the ink reservoir 102 is transparent and does not degrade the appearance because ink is not left on the portion where the slide plug slides.

Figure 15:
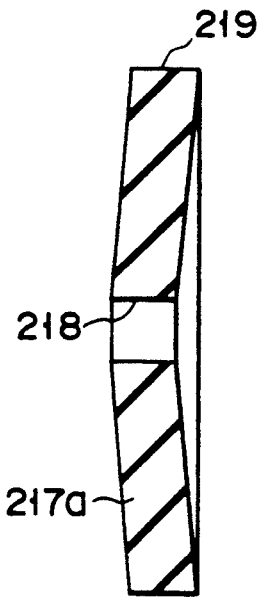
FIG. 15 is a longitudinal sectional view of another embodiment of the sealing portion of the slide plug.

It is also possible to use a conical sealing member 217*a* for the above sealing portion as shown in FIG. 15. When the sealing member 217*a* moves, for example, rightward in FIG. 15, its diameter and sliding resistance increase. When it moves leftward, the sliding resistance decreases. When the sealing member 217*a* is used, the sliding resistance of a slide plug increases and the pressure in an ink reservoir increases for writing. When the slide plug returns after writing, it smoothly slides because the sliding resistance is small.

For the white board marker of the embodiment shown in FIGS. 7 through 14, when a cap is applied, the air in the cap is compressed and the compressed air may enter the ink reservoir 102 through the felt tip 104 because no check-valve system is installed. To prevent the above trouble, it is possible to install a check-valve system as the ninth embodiment in FIG. 16 shows.

Figure 16:
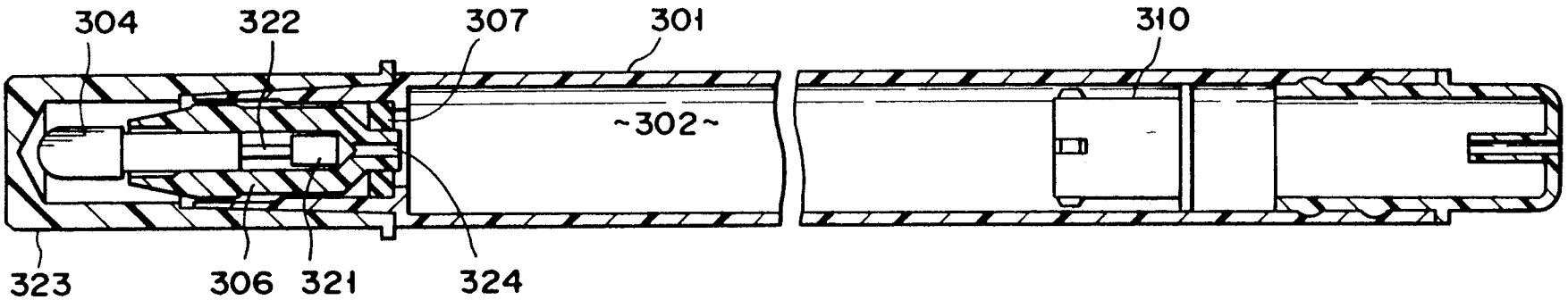
FIG. 16 is a longitudinal sectional view to the white-board marker of the ninth embodiment.

That is, for the embodiment in FIG. 16, an ink reservoir 302 is formed in a body 301 and a slide plug 310 is inserted. A holder 310 is slidably fitted into the front end of the body 30 and its rear end is fitted to a disk piston 307 made of an elastic material such as synthetic rubber. A felt tip 304 is held by the holder 306 and ink is supplied from the ink reservoir 302 to the felt tip 304 through a path 324 formed in the holder 306. A check valve 321 is installed at the middle of the path 324. The check valve 321 is made of an elastic material such as silicone rubber and a stem 322 is protruded from the front end of the valve. The end of the stem is pressed against the felt tip 304 and the check valve 321 is closed by the elasticity of the stem 322.

For this embodiment, if the air in a cap 323 is compressed when the cap 323 is fitted into the body 301, the check valve 321 prevents the compressed air from entering the ink reservoir 302 through the felt tip 304.

What is claimed is:

1. A marker for applying ink to a certain portion on a surface to be coated, said marker comprising:

a cylindrical ink reservoir formed within a body;

a slide plug slidable within said body, said slide plug being maintained in a liquid tightness with an inner periphery of said body, partitioning ink in said ink reservoir from air, and sliding in said body according to consumption, expansion, and contraction of the ink, said slide plug being formed of an elastic material and having a redetermined sliding resistance based on friction with an inside wall of said ink reservoir;

a pen element slidably mounted at a front end of said body so as to slide back and forth in accordance with writing pressure; and pump means mounted in said body for pressurizing the ink in said ink reservoir formed within said body when said pen element slides in accordance with writing pressure, wherein the pen element slides back in accordance with writing pressure, and the ink in the ink reservoir is pressed by the pump means, whereby the sliding plug slides to determine and control the pressure applied to the ink in the ink reservoir and the ink in the ink reservoir is supplied to the pen element.

2. A marker according to claim 1, wherein said pump means is a piston made of an elastic material and is installed between said pen element and said ink reservoir, and is elastically deformed to pressurize the ink in said ink reservoir when said pen element slides in accordance with writing pressure.

3. A marker according to claim 1, wherein a sealing portion made of an elastic material adhering to the inner periphery of said ink reservoir is formed on an outer periphery of said slide plug and withdrawal stroke of said slide plug is greater than a sealing width of said sealing portion in an axial direction of the sealing portion, when the sealing portion adheres to the inner periphery of said ink reservoir and the stroke for withdrawal of said slide plug due to pressure of the ink in the ink reservoir is produced by said pump means when a standard writing pressure is applied to said pen element.

4. A marker according to claim 3, wherein the standard writing pressure is 100 g.

* * * * *